US008444303B2

(12) United States Patent
Chu

(10) Patent No.: US 8,444,303 B2
(45) Date of Patent: May 21, 2013

(54) HEAT DISSIPATION ARRANGEMENT FOR LED LIGHTING DEVICE

(75) Inventor: Song-Fa Chu, Kaohsiung (TW)

(73) Assignee: Hua Bo Tech (Zhuhai) Industry Co., Ltd., Zhuhai (CN)

( * ) Notice: Subject to any disclaimer, the term of this patent is extended or adjusted under 35 U.S.C. 154(b) by 798 days.

(21) Appl. No.: 12/646,994

(22) Filed: Dec. 24, 2009

(65) Prior Publication Data

US 2011/0157872 A1 Jun. 30, 2011

(51) Int. Cl.
*F21V 29/00* (2006.01)

(52) U.S. Cl.
USPC ..... 362/373; 362/547; 362/294

(58) Field of Classification Search
USPC ..... 362/101, 294, 373, 547
See application file for complete search history.

(56) References Cited

U.S. PATENT DOCUMENTS

2008/0043479 A1* 2/2008 Wang ..... 362/373
2010/0110679 A1* 5/2010 Teng et al. ..... 362/235

* cited by examiner

*Primary Examiner* — Joseph L Williams

(57) ABSTRACT

An LED lighting device includes a plurality of parallel illumination assemblies each including an elongated metal bar and a plurality of LED elements secured to the bar, and a heat dissipation assembly comprising a metal substrate comprising a plurality of hollow posts arranged in rows on a top surface; a plurality of parallel metal units each comprising a rod releasably secured to both the substrate and the bar, the rod including a plurality of hollow, closed U-shaped members each partially fastened in the post; and a plurality of metal frame members for releasably securing the rods together.

1 Claim, 4 Drawing Sheets

HEAT DISSIPATION ARRANGEMENT FOR LED LIGHTING DEVICE

BACKGROUND OF THE INVENTION

1. Field of Invention

The invention relates to LED (light-emitting diode) lighting devices and more particularly such an LED lighting device (e.g., street light) having an improved heat dissipation arrangement.

2. Description of Related Art

LEDs are renowned for their long life and their ability to resist shock. Also, an LED consumes much less electrical power than fluorescent lamps (i.e., energy saving). Therefore, LED lighting devices are gaining popularity worldwide.

Recently, LEDs as a light source have been employed in outdoor lighting devices (e.g., street lights). Typically, heat dissipation is an important issue to be addressed in the manufacturing of an LED lamp because LED elements are sensitive to temperature conditions.

One conventional LED lamp has a metal globe for concealing LEDs. However, the heat dissipation performance of the LED lamp is poor because the globe is not in contact with the LEDs and natural air ventilation is blocked by the globe.

Another conventional LED lamp as an improvement of the above LED lamp has plurality of fins mounted on a lamp casing. Heat generated by LEDs can be discharged through the fins. However, it is a one way heat dissipation path. Hence, its heat dissipation performance is still low. Further, the exposed fins are visually unattractive (i.e., ugly). Furthermore, the globe and the fins, made of aluminum or alloy thereof due to the consideration of cost reduction, are inferior to ones made of copper in terms of heat conduction performance.

There have been numerous suggestions in prior patents for LED lighting device. For example, U.S. Pat. No. 6,942,361 discloses a light source for white color LED lighting and white color LED lighting device. Thus, continuing improvements in the exploitation of LED lighting device having an improved heat dissipation arrangement are constantly being sought.

SUMMARY OF THE INVENTION

It is therefore one object of the invention to provide an LED lighting device comprising a plurality of parallel illumination assemblies each including an elongated metal bar and a plurality of LED elements secured to the bar, and a heat dissipation assembly comprising a metal substrate comprising a plurality of hollow posts arranged in rows on a top surface; a plurality of parallel metal units each comprising a rod releasably secured to both the substrate and the bar, the rod including a plurality of hollow, closed U-shaped members each partially fastened in the post; and a plurality of metal frame members for releasably securing the rods together.

The above and other objects, features and advantages of the invention will become apparent from the following detailed description taken with the accompanying drawings.

DETAILED DESCRIPTION OF THE INVENTION

Figure 1:
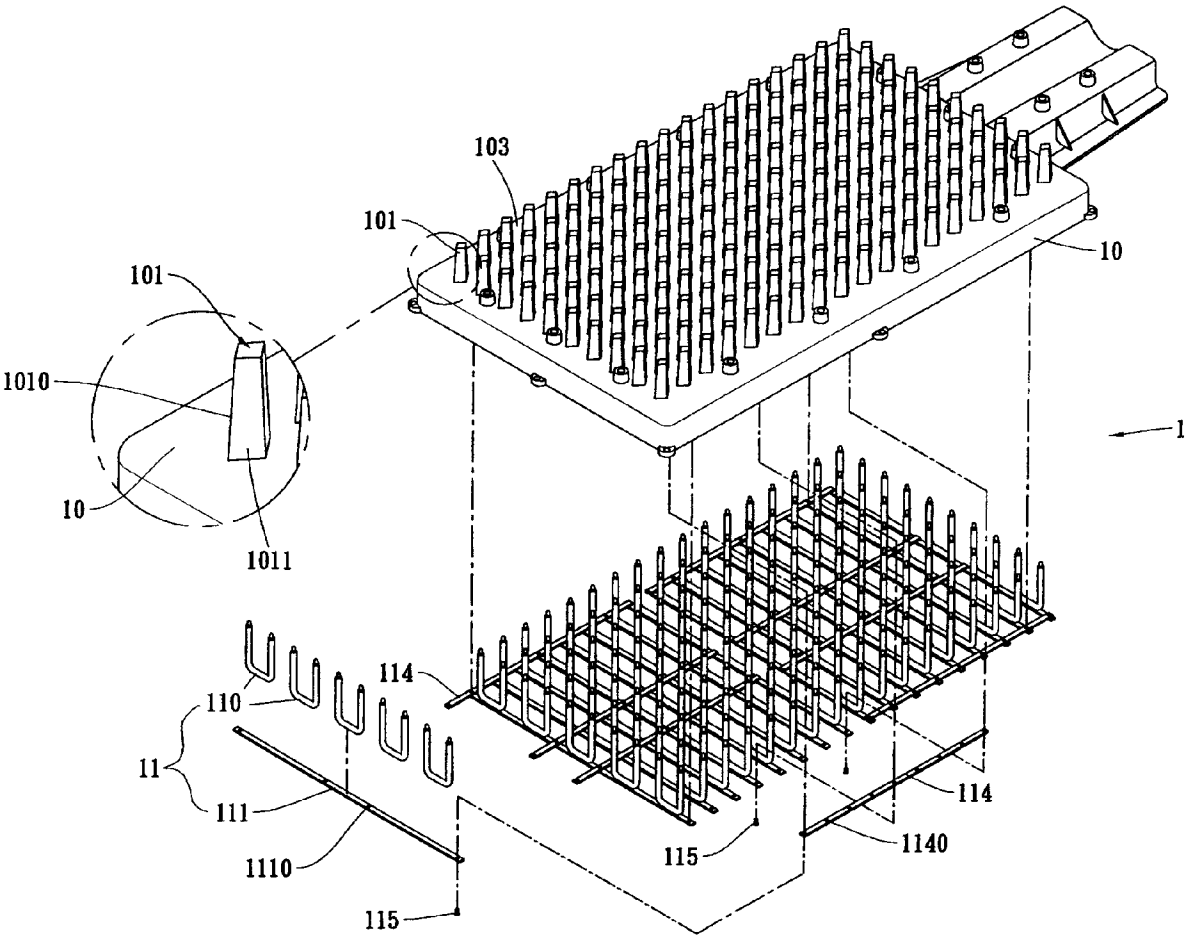
FIG. 1 is an exploded view of a preferred embodiment of heat dissipation arrangement for LED lighting device according to the invention viewed from a position above the heat dissipation arrangement.
Figure 2:
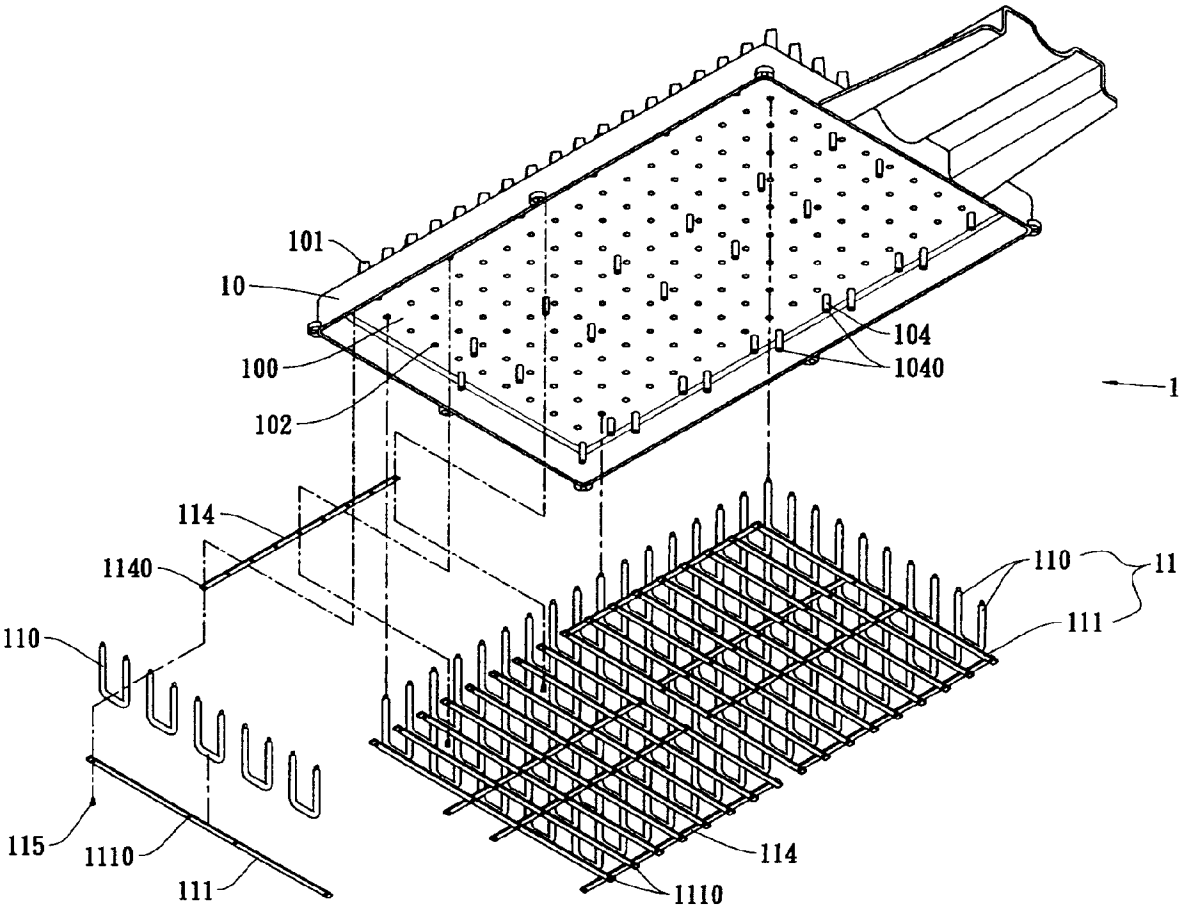
FIG. 2 is another exploded view of the heat dissipation arrangement viewed from a position thereunder.
Figure 3:
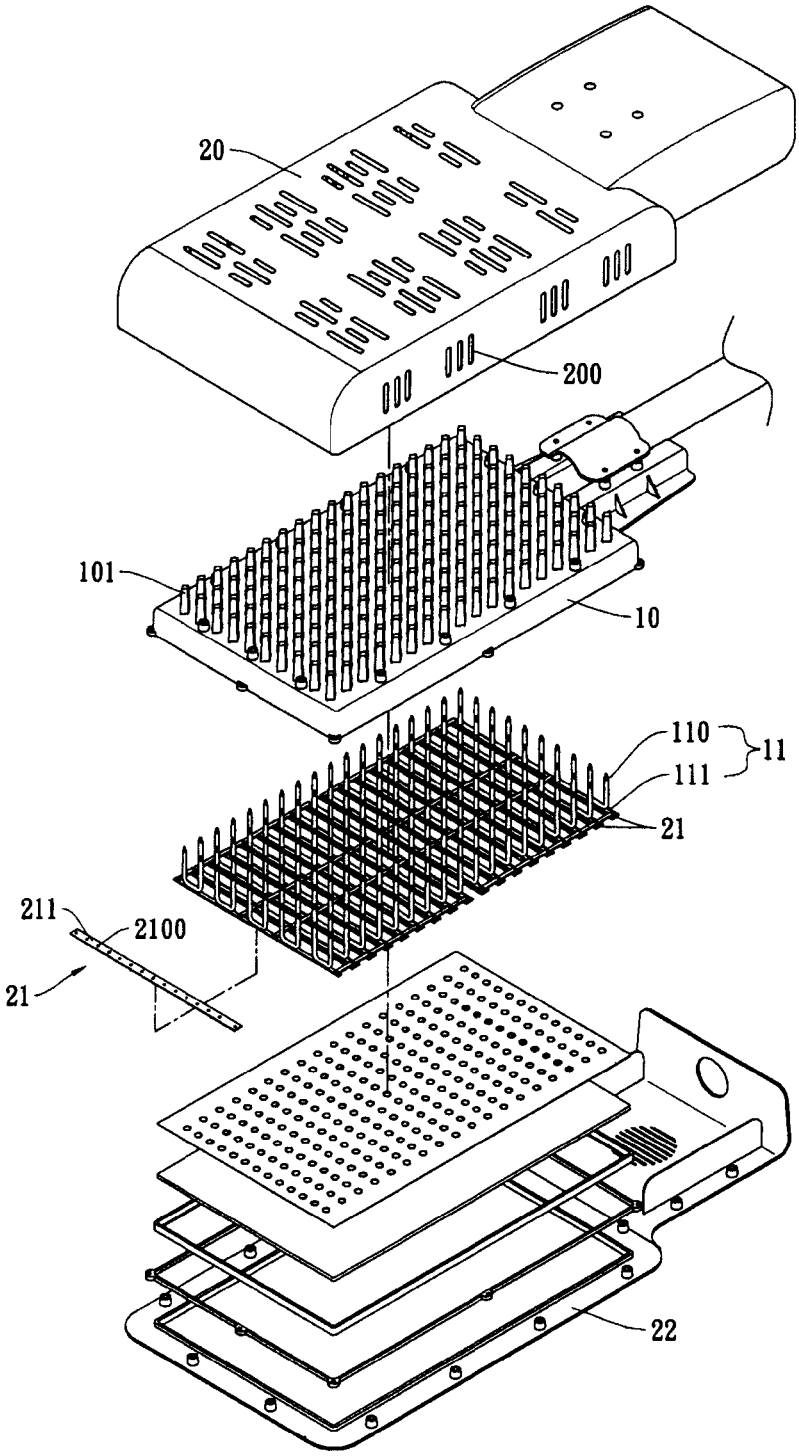
FIG. 3 is an exploded view of a portion of LED lighting device to be mounted with the heat dissipation arrangement.
Figure 4:
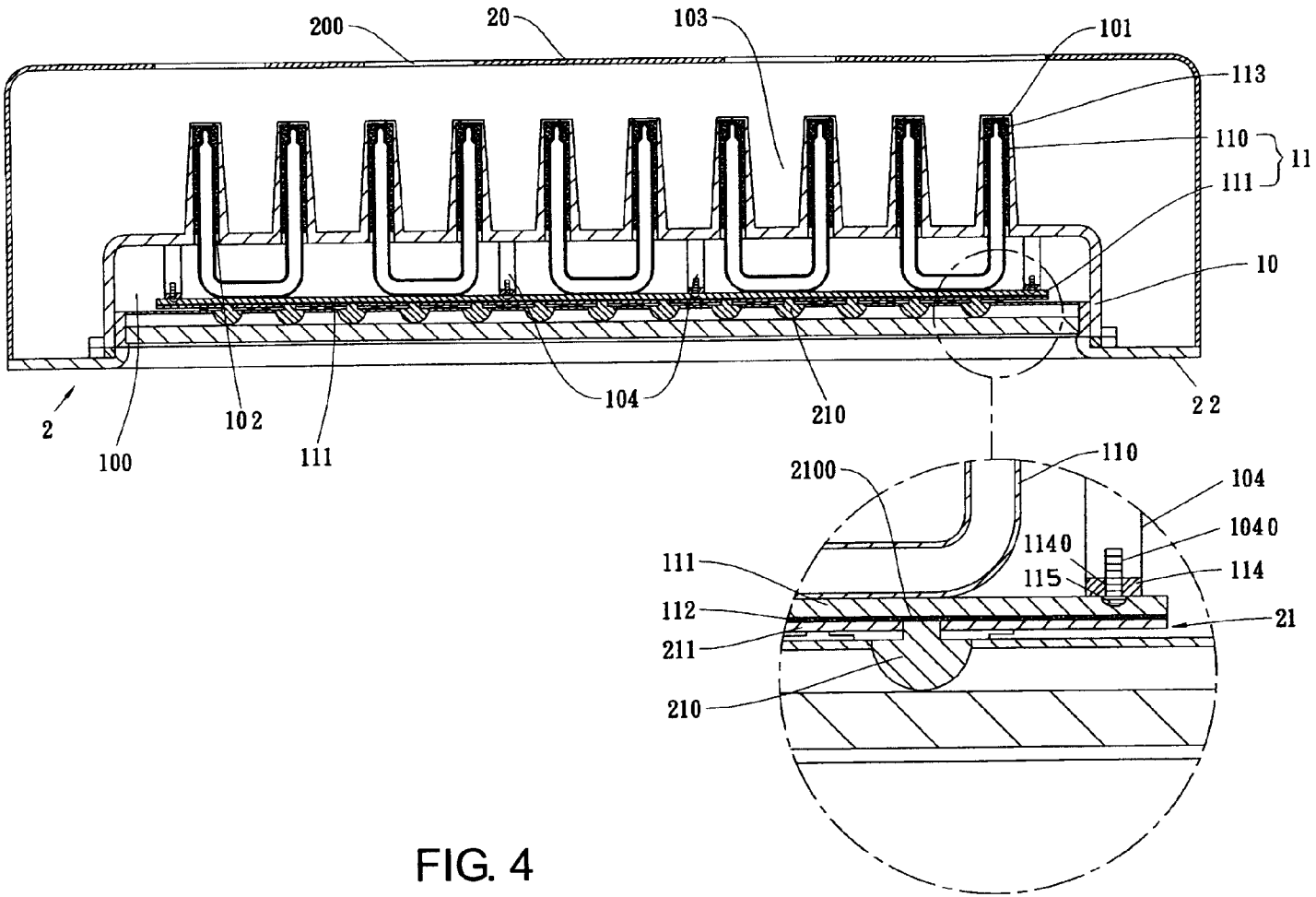
FIG. 4 is a longitudinal sectional view of the assembled LED lighting device and the heat dissipation arrangement.

Referring to FIGS. 1 to 4, an LED lighting device (e.g., street light in this embodiment) 2 incorporating a preferred embodiment of heat dissipation arrangement 1 according to the invention is shown. The heat dissipation arrangement 1 comprises the following components as discussed in detail below.

A substrate 10 is made of copper or alloy thereof of excellent conductor of heat. The substrate 10 is shaped as a rectangular, shallow shroud with a space 100 open to the bottom. A plurality of hollow posts 101 arranged in rows on a top surface with a plurality of passageways 103 formed therebetween. The post 101 is tapered and has a rhombic cross-section. The posts 101 may have a cross-section such as triangle or pentagon in other embodiments. The post 101 has four inclined side surfaces 1011 and four inclined edges 1010. A plurality of holes 102 are formed on bottom of the substrate 10. Each hole 102 is aligned with the hollow of the post 101.

A plurality of parallel heat conduction assemblies 11 are made of copper or alloy thereof of excellent conductor of heat. The heat conduction assembly 11 comprises an elongated rod 111 including a plurality of spaced threaded holes 1110. The rod 111 may be hollow in other embodiments. The heat conduction assembly 11 further comprises a plurality of hollow, closed U-shaped members (i.e., heat pipes) 110 equally spaced along the rod 111 and secured thereto. A small quantity of water is contained in the U-shaped member 110. The U-shaped members 110 have sharp ends. The U-shaped members 110 are partially fitted in the posts 101 by inserting through the holes 102.

The heat conduction assembly 11 further comprises a plurality of elongated rod-shaped frame members 114 each having a plurality of spaced threaded holes 1140. The frame members 114 are made of copper or alloy thereof of excellent conductor of heat. The heat conduction assembly 11 further comprises a plurality of metal positioning pegs 104 projecting out of the bottom of the substrate 10, the positioning peg 104 having a threaded hole 1040. The positioning pegs 104 are formed of copper or an alloy thereof.

A plurality of threaded fasteners (e.g., screws) 115 are driven through the threaded holes 1110, 1140 to secure the frame members 114 and the rods 111 together and secure the heat conduction assemblies 11 and the substrate 10 together. Also, a plurality of threaded fasteners (e.g., screws) 115 are driven through the threaded holes 1140, 1040 to secure the frame members 114 and the positioning pegs 104 together. As a result, the assembled heat conduction assemblies 11 are shaped as a grid and are mounted in the substrate 10.

The street light 2 comprises a shade 20 shaped as a rectangular, shallow shroud with a space open to the bottom, the shade 20 having a plurality of openings 200 on top and side surfaces for air ventilation purposes. The street light 2 further comprises a plurality of parallel illumination assemblies 21 each including an elongated bar 211 made of copper or alloy thereof of excellent conductor of heat, the elongated bar 211 having a plurality of spaced holes 2100, and a plurality of LED elements 210 fastened in the holes 2100. A plurality of heat conductive members 113 each is fastened between the rod 111 and the elongated bar 211 to contact the LED element

210. The street light 2 further comprises a transparent bottom board 22 threadedly secured to the shade 20. As an end, the street light 2 is assembled.

In use, heat generated by the LED elements 210 is transferred to the rods 111 via the heat conductive members 113 and both the bars 211 and the heat conductive members 113. And in turn, heat is transferred from the rods 111 to the main body of the substrate 10 via both the frame members 114 and the positioning pegs 104, and the posts 101 via the U-shaped members 110. Moreover, water in the U-shaped members 110 can increase heat transfer to the posts 101 due to capillary attraction. Further, the passageways 103 can facilitate air movement to carry heat out of the inclined side surfaces 1011 of the posts 101. Furthermore, the openings 200 of the shade 20 can increase air ventilation. As a result, heat is quickly effectively dissipated from the street light 2.

While the invention herein disclosed has been described by means of specific embodiments, numerous modifications and variations could be made thereto by those skilled in the art without departing from the scope and spirit of the invention set forth in the claims.

What is claimed is:

1. An LED lighting device comprising a plurality of parallel illumination assemblies each including an elongated metal bar and a plurality of LED elements secured to the bar, and a heat dissipation assembly comprising:

a metal substrate comprising a plurality of hollow posts arranged in rows on a top surface;

a plurality of parallel metal units each comprising a rod releasably secured to both the substrate and the bar, the rod including a plurality of hollow, closed U-shaped members each partially fastened in the post;

a plurality of metal frame members for releasably securing the rods together;

a plurality of heat conductive members each fastened between the rod and the bar to contact the LED element; and a plurality of metal positioning pegs releasably secured to the frame members.

* * * * *